US007740405B2

(12) United States Patent
Ohta et al.

(10) Patent No.: US 7,740,405 B2
(45) Date of Patent: Jun. 22, 2010

(54) CASSETTE

(75) Inventors: Yasunori Ohta, Kanagawa (JP); Eiichi Kito, Kanagawa (JP); Tsuyoshi Tanabe, Kanagawa (JP); Takuya Yoshimi, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 12/222,940

(22) Filed: Aug. 20, 2008

(65) Prior Publication Data

US 2009/0052629 A1 Feb. 26, 2009

(30) Foreign Application Priority Data

Aug. 20, 2007 (JP) ..... 2007-213700
Jul. 4, 2008 (JP) ..... 2008-175549
Aug. 15, 2008 (JP) ..... 2008-209114

(51) Int. Cl.
*H01J 31/49* (2006.01)

(52) U.S. Cl. ..... 378/189

(58) Field of Classification Search ..... 378/98.8, 378/189–192

See application file for complete search history.

(56) References Cited

U.S. PATENT DOCUMENTS 5,844,961 A * 12/1998 McEvoy et al. ..... 378/98.8
7,126,129 B2 10/2006 Yamamoto
2008/0054182 A1* 3/2008 Yokoyama et al. ..... 250/370.09

FOREIGN PATENT DOCUMENTS

JP 07-140255 6/1995
JP 2000-105297 4/2000
JP 2004-173907 6/2004

* cited by examiner

*Primary Examiner*—Irakli Kiknadze
(74) *Attorney, Agent, or Firm*—Jean C. Edwards, Esq.; Akerman Senterfitt

(57) ABSTRACT

A cassette includes a main cassette body having a radiation detector for detecting radiation that has passed through a subject and converting the detected radiation into radiation image information, and a communication unit for wireless communications with a console. The communication unit is connected to the main cassette body by a cable and detachably mounted in a cradle part on said main cassette body.

8 Claims, 12 Drawing Sheets

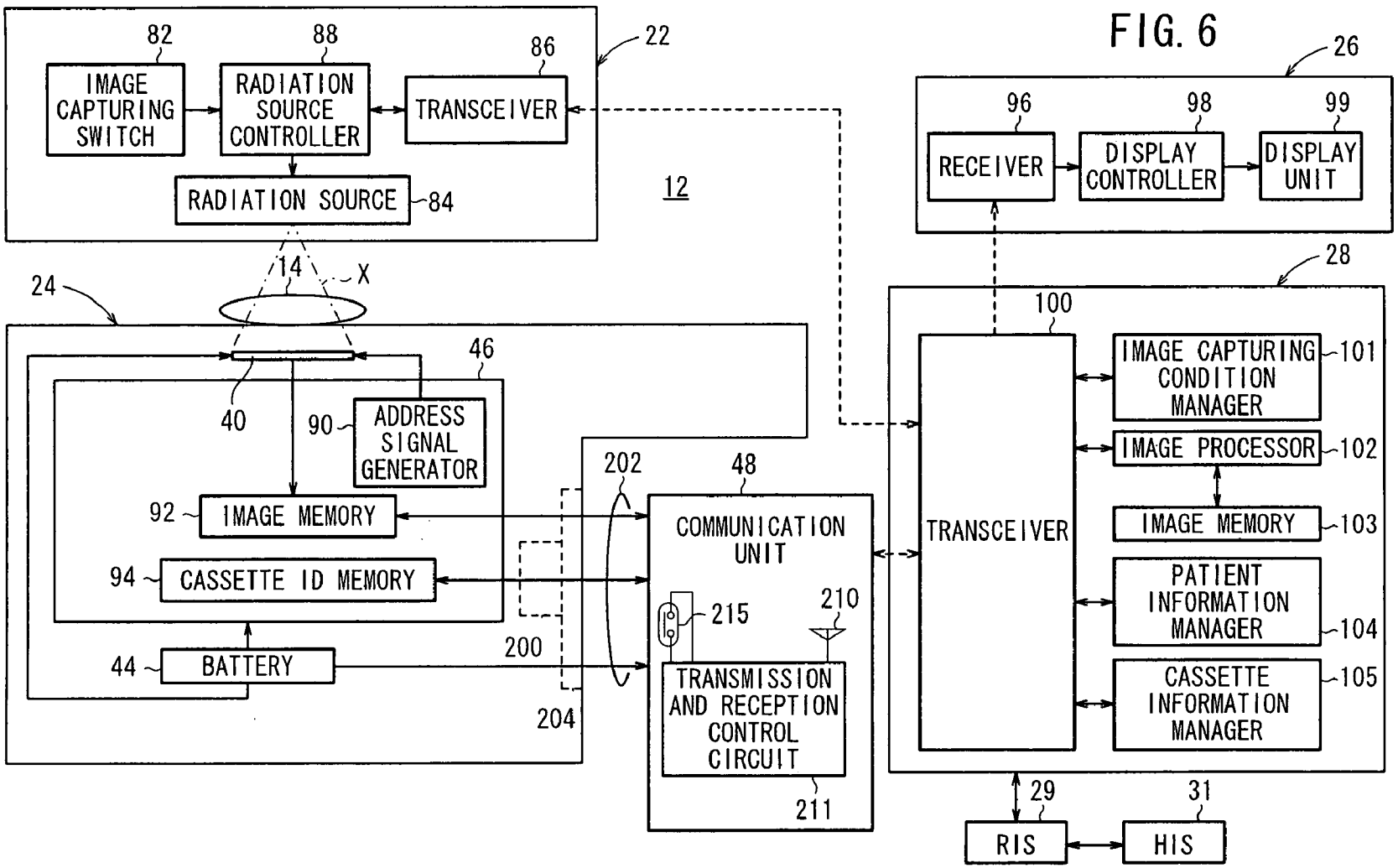
FIG. 6
26
96
RECEIVER
98
DISPLAY CONTROLLER
99
DISPLAY UNIT
28
100
TRANSCEIVER
101
IMAGE CAPTURING CONDITION MANAGER
102
IMAGE PROCESSOR
103
IMAGE MEMORY
104
PATIENT INFORMATION MANAGER
105
CASSETTE INFORMATION MANAGER
29
RIS
31
HIS
12
22
82
IMAGE CAPTURING SWITCH
88
RADIATION SOURCE CONTROLLER
86
TRANSCEIVER
84
RADIATION SOURCE
X
14
40
24
46
90
ADDRESS SIGNAL GENERATOR
92
IMAGE MEMORY
94
CASSETTE ID MEMORY
44
BATTERY
200
202
204
48
COMMUNICATION UNIT
210
215
211
TRANSMISSION AND RECEPTION CONTROL CIRCUIT

CASSETTE

CROSS-REFERENCE TO RELATED APPLICATIONS

The present application claims priority from Japanese Patent Application Nos. 2007-213700, filed Aug. 20, 2007, 2008-175549 filed Jul. 4, 2008, and 2008-209114 filed Aug. 15, 2008, the contents of all of which are herein incorporated by reference in their entirety.

BACKGROUND OF THE INVENTION

1. Field of the Invention

The present invention relates to a cassette having a radiation detector for detecting a radiation that has passed through a subject and converting the detected radiation into radiation image information.

2. Description of the Related Art

In the medical field, there have widely been used radiation image capturing apparatus which apply a radiation to a subject and guide the radiation that has passed through the subject to a radiation detector, which captures a radiation image from the radiation. Known forms of the radiation detector include a conventional radiation film for recording a radiation image by way of exposure, and a stimulable phosphor panel for storing radiation energy representing a radiation image in a phosphor and reproducing the radiation image as stimulated light by applying stimulating light to the phosphor. The radiation film with the recorded radiation image is supplied to a developing device to develop the radiation, or the stimulable phosphor panel is supplied to a reading device in order to read the radiation image as a visible image.

In an operating room or the like, it is necessary to read a recorded radiation image immediately from a radiation detector after the radiation image has been captured, for the purpose of quickly and appropriately treating the patient. As a radiation detector which meets such a requirement, there has been developed a radiation detector having a solid-state detector for converting radiation directly into electric signals or for converting radiation into visible light with a scintillator and then converting the visible light into electric signals, so as to read the detected radiation image.

As shown in FIG. 12 of the accompanying drawings, Japanese Laid-Open Patent Publication No. 2004-173907 discloses a cassette (electronic cassette) 306 having a battery 304 and an image memory 305 and connected to a cable 302 having a connector 300. It also discloses an X-ray image capturing system in which a connector 310 on a cable 308 or a wireless module 330 is connected to the connector 300, a controller 314 with a power supply 312 is connected to the connector 300 by the cable 308 or a wireless terminal 322, and an X-ray generator 318 having an X-ray bulb 317 is connected to the controller 314 by a cable 316. The controller 314 is combined with a monitor 320 for displaying captured images and a storage 338 for storing captured images.

The technology disclosed in Japanese Laid-Open Patent Publication No. 2004-173907 is problematic in that the cable 302 connected to the cassette 306 is cumbersome when the cassette 306 is carried around.

Japanese Patent No. 3494683 discloses a cassette which transmits captured radiation image information to a controller by way of wireless communications. According to the technology disclosed in Japanese Patent No. 3494683, no cumbersome cable is connected to the cassette.

According to Japanese Patent No. 3494683, no cumbersome cable is connected to the cassette as image data are transmitted from the cassette to the controller by way of wireless communications. However, when the cassette communicates with the controller after the cassette is set between a patient to be imaged and a bed on which the patient lies, if the directivity of an antenna of the cassette and the directivity of an antenna of the controller are not aligned with each other, then the transmission and reception sensitivity of the cassette and the controller is greatly reduced. One solution is to increase the intensity of a radio wave transmitted from the antenna of the cassette. The increased intensity of the radio wave transmitted from the antenna of the cassette necessarily results in an increase in the power consumption of the cassette.

Particularly, after the cassette disclosed in Japanese Patent No. 3494683 is set between the patient and the bed, it is difficult to change the orientation of the cassette for increasing the transmission and reception sensitivity of the cassette and the controller. If the patient on the bed is seriously ill or an aged person, then it is all the more difficult to change the orientation of the cassette.

There is nothing disclosed in Japanese Laid-Open Patent Publication No. 2004-173907 for matching the directivity between the wireless module 330 and the wireless terminal 322.

SUMMARY OF THE INVENTION

It is an object of the present invention to provide a cassette which will not find any cables connected thereto cumbersome when the cassette is carried around and which allows the attitude of an antenna thereof to be changed easily when radiation image information is to be captured in the cassette.

A cassette according to the present invention comprises a main cassette body having a radiation detector for detecting a radiation that has passed through a subject and converting the detected radiation into radiation image information, and a communication unit for wireless communications with an external control device, the communication unit being connected to the main cassette body by a cable and detachably mounted on the main cassette body.

Since the cassette can be carried around with the communication unit being mounted on the main cassette body, an operator who handles the cassette does not find the cable cumbersome when the operator carries around the cassette. As the communication unit can be separated from the main cassette body while radiation image information is being captured in the cassette, the communication unit and hence the antenna can easily be changed in attitude.

The main cassette body and the cable, or the cable and the communication unit may be detachably connected to each other by a connector.

The cassette may further comprise a take-up mechanism mounted in the main cassette body or the communication unit for winding up the cable such that the cable can be reeled out from the take-up mechanism. The cable can thus be stored compactly in the main cassette body or the communication unit.

The communication unit may comprise a mobile terminal such as a PHS phone, a cellular phone, or the like, so that it can utilize an existing communication infrastructure for communications.

According to the present invention, since the cassette can be carried around with the communication unit being mounted on the main cassette body, the operator does not find the cable cumbersome when the cassette is carried around. As the communication unit can be separated from the main cassette body while radiation image information is being captured in the cassette, the communication unit and hence the antenna can easily be changed in attitude.

The communication unit and/or the external control device may include an indicating unit for indicating field intensity information of the wireless communications. On the basis of the indicated field intensity information, the operator can place the communication unit in a position where the field intensity is maximum.

Preferably, the cassette may further comprises a detecting unit mounted in the communication unit or the main cassette body, for detecting whether the communication unit is separated away from the main cassette body or not.

The above and other objects, features, and advantages of the present invention will become more apparent from the following description when taken in conjunction with the accompanying drawings in which preferred embodiments of the present invention are shown by way of illustrative example.

BRIEF DESCRIPTION OF THE DRAWINGS

FIG. 6 is a block diagram of the radiation image capturing system shown in FIG. 1;

DESCRIPTION OF THE PREFERRED EMBODIMENTS

Figure 1:
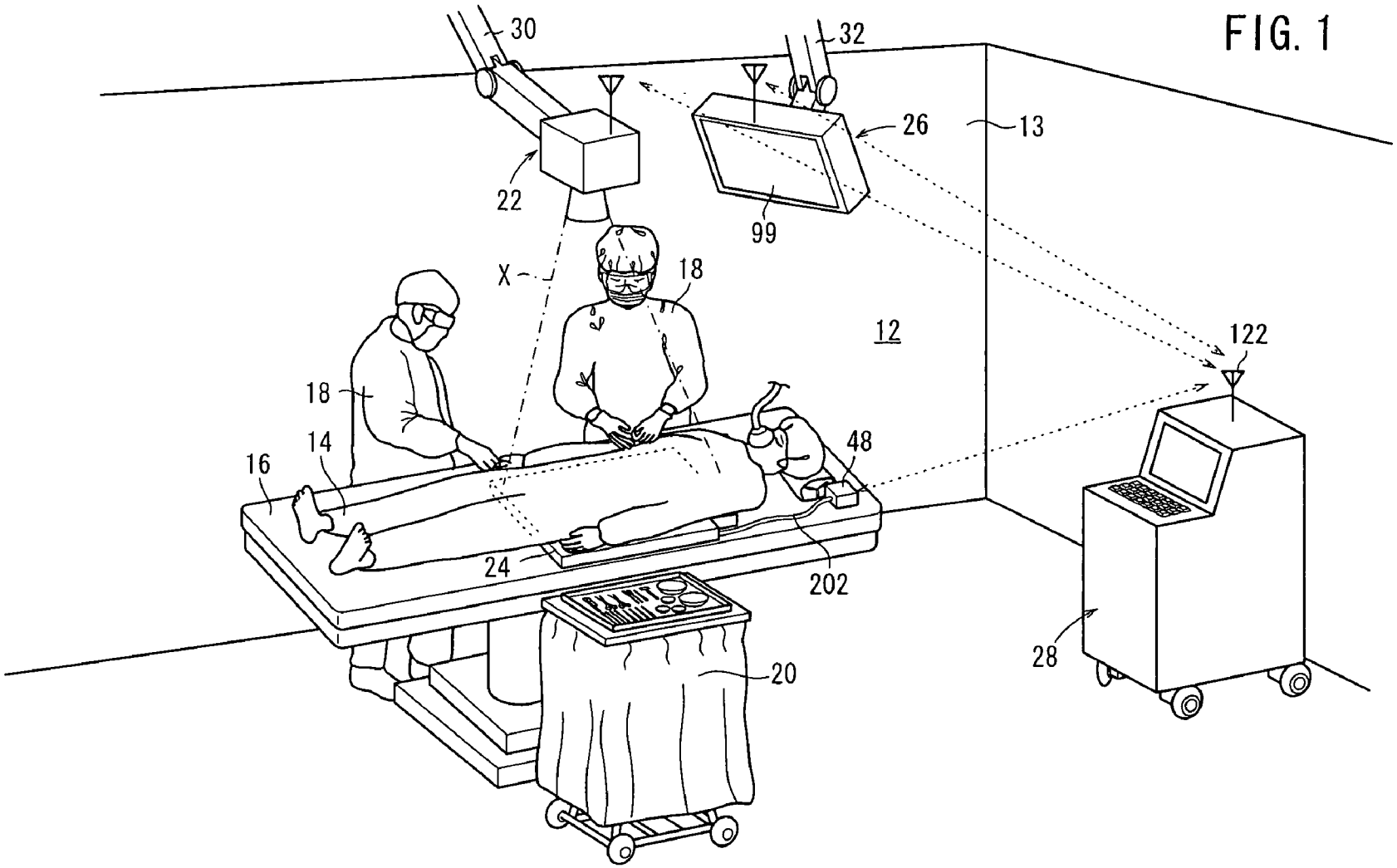
FIG. 1 is a perspective view of an operating room incorporating a radiation image capturing system which uses a cassette according to an embodiment of the present invention.

Like or corresponding parts are denoted by like or corresponding reference characters throughout views.

Cassettes according to preferred embodiments of the present invention, which are used in combination with radiation image capturing systems, will be described in detail below with reference to the accompanying drawings.

FIG. 1 shows in perspective an operating room 13 incorporating a radiation image capturing system 12 which employs a cassette 24 according to an embodiment of the present invention. As shown in FIG. 1, the operating room 13 has, in addition to the radiation image capturing system 12 which employs the cassette 24, a surgical table 16 for a patient 14 to lie thereon, and an instrument table 20 disposed on one side of the surgical table 16 for placing thereon various tools and instruments to be used by surgeons 18 operating on the patient 14. The surgical table 16 is surrounded by various apparatus required for performing surgical operations, including an anesthesia apparatus, an aspirator, an electrocardiograph, a blood pressure monitor, etc.

The radiation image capturing system 12 includes an image capturing apparatus 22 for irradiating the patient 14 with a radiation X at a dose according to image capturing conditions, a cassette (radiation detecting cassette) 24 housing therein a radiation detector, to be described later, for detecting the radiation X that has passed through the patient 14, a display device 26 for displaying a radiation image based on the radiation X that is detected by the radiation detector, and a console (external control device) 28, which serves as an image processor, for controlling the image capturing apparatus 22, the cassette 24, and the display device 26.

The console 28, the image capturing apparatus 22, the cassette 24, and the display device 26 send and receive signals by way of wireless communications as indicated by the broken lines.

The image capturing apparatus 22 is coupled to a universal arm 30 so as to be movable to a desired position for capturing images at a desired area of the patient 14 and also to be retractable to an out-of-the-way position while the surgeons 18 are performing a surgical operation on the patient 14. Similarly, the display device 26 is coupled to a universal arm 32 so as to be movable to a position where the surgeons 18 can easily confirm a captured radiation image displayed on the display device 26.

Figure 2:
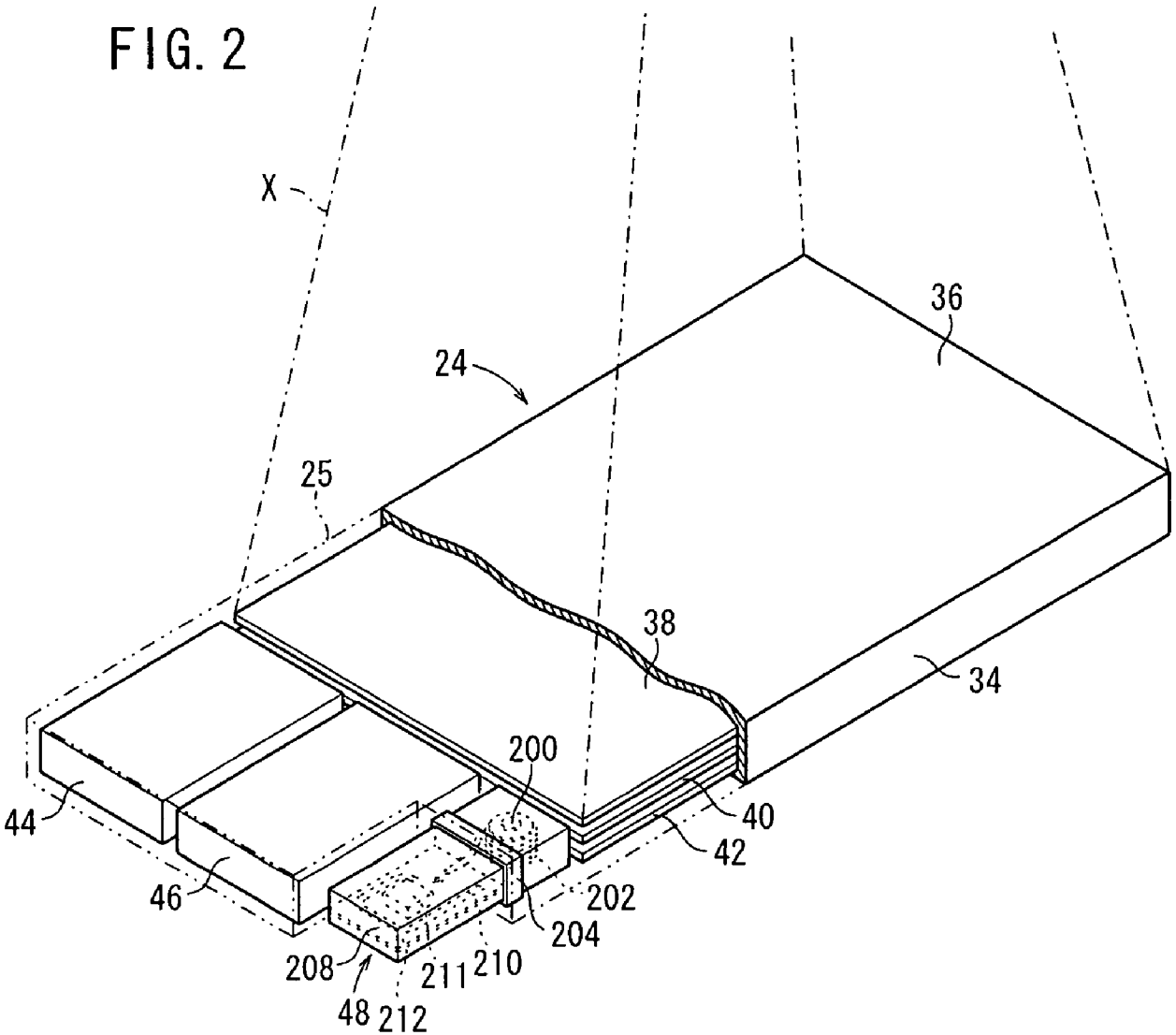
FIG. 2 is a perspective view, partly cut away, of a radiation detecting cassette as the cassette shown in FIG. 1.

FIG. 2 shows, in perspective, partly cut away, the cassette 24 shown in FIG. 1. As shown in FIG. 2, the cassette 24 has a casing 34 made of a material that is permeable to radiation X. The casing 34 houses therein a grid 38 for removing scattered rays from the radiation X from the patient 14, a radiation detector 40 for detecting radiation X that has passed through the patient 14, and a lead plate 42 for absorbing back scattered rays from the radiation X. The grid 38, the radiation detector 40, and the lead plate 42 are successively arranged in that order from an irradiated surface 36 of the casing 34, which is irradiated with radiation X. The irradiated surface 36 of the casing 34 may also be constructed so as to form the grid 38.

The casing 34 also houses therein a battery 44 as a power supply of the cassette 24, a cassette controller 46 for energizing the radiation detector 40 with electric power supplied from the battery 44, a take-up mechanism 200 for winding a flexible cable 202, and a cradle part 204 mounted on a distal end of the take-up mechanism 200.

The casing 34, the grid 38, the radiation detector 40, the lead plate 42, the battery 44, the cassette controller 46, the take-up mechanism 200, and the cradle part 204 jointly make up a main cassette body 25 of the cassette 24. The cassette 24 is constructed of the main cassette body 25 and a communication unit 48 that is connected to the main cassette body 25 by a cable 202.

Figure 5:
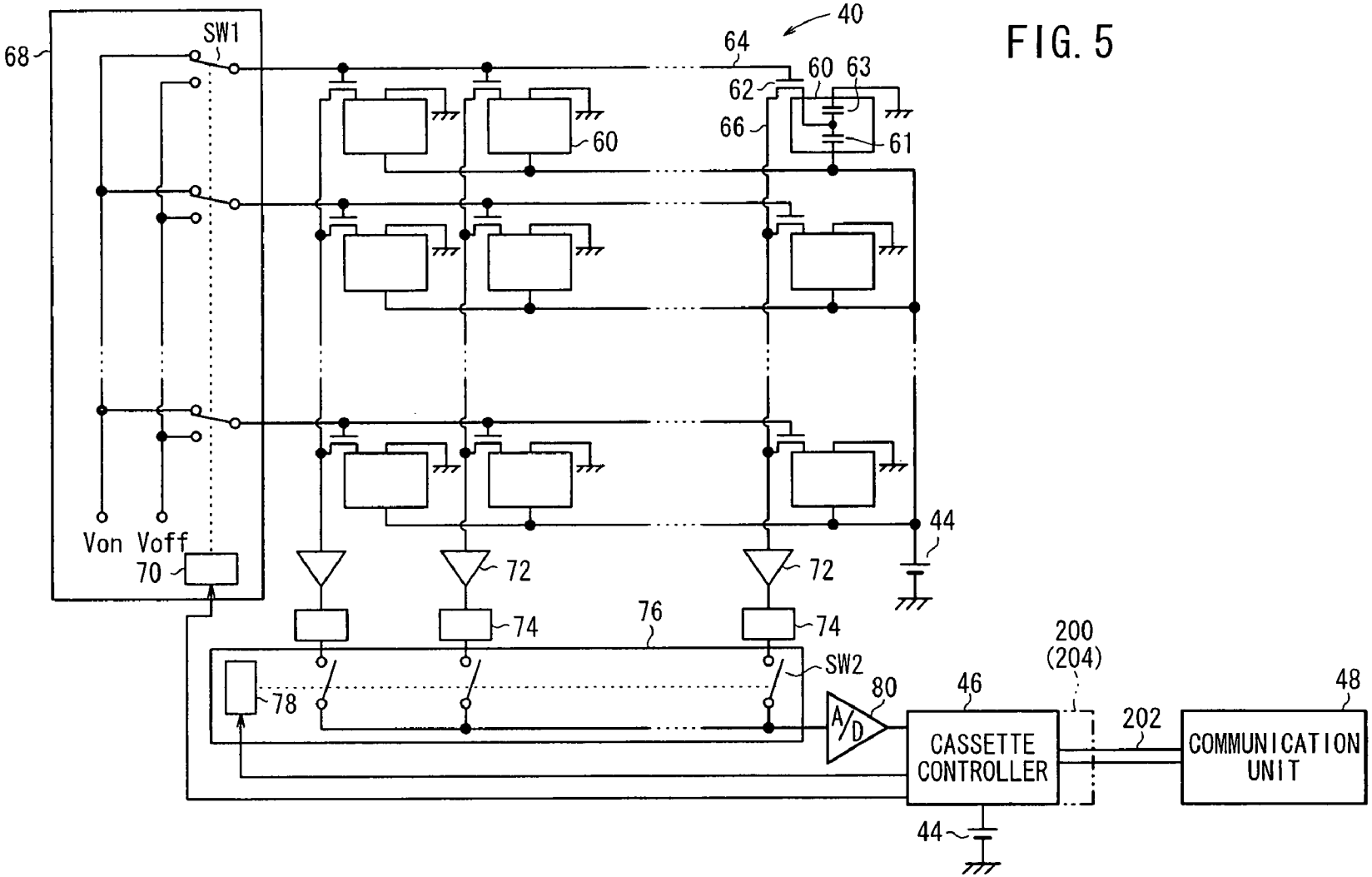
FIG. 5 is a block diagram of a circuit arrangement of a radiation detector of the cassette shown in FIG. 2.

The take-up mechanism 200 stores therein the cable 202 as a wound roll so that the cable 202 can be reeled out to a desired length under the tension of a tension spring acting thereon. The cable 202 has an end connected to the cassette controller 46 and the other end to the communication unit 48 through the cradle part 204, as shown in FIG. 5.

Figure 3:
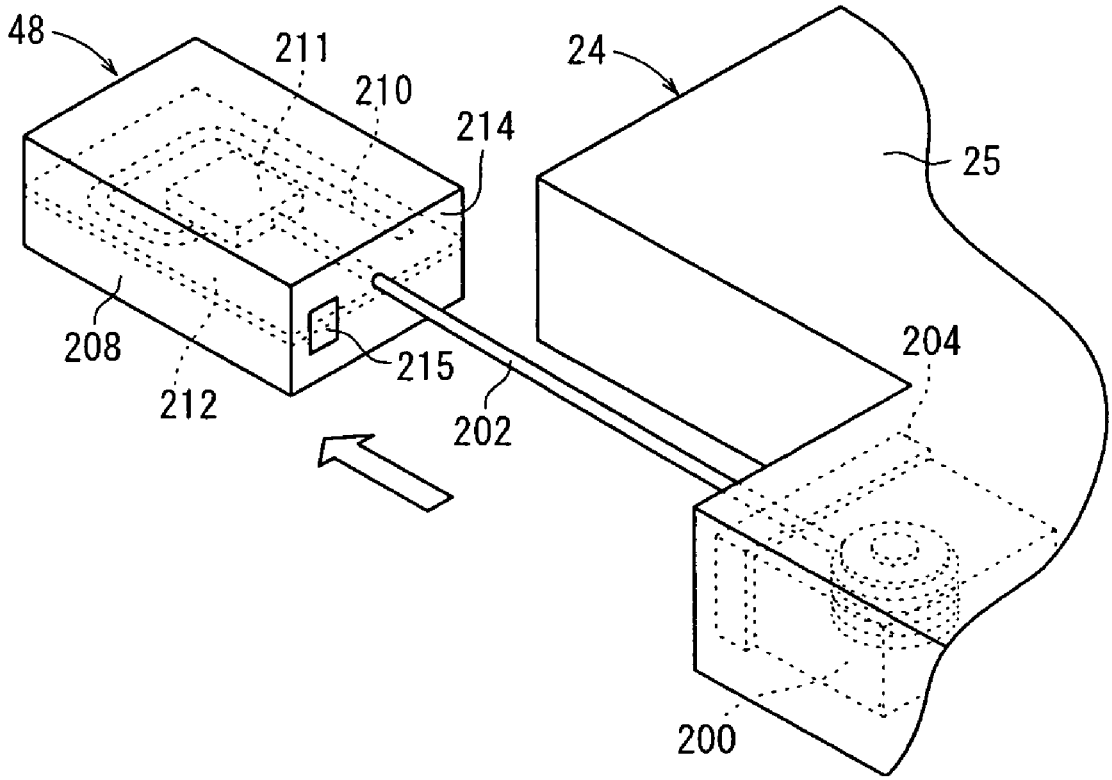
FIG. 3 is a fragmentary perspective view of the radiation detecting cassette with a communication unit being pulled away from a main cassette body.

As shown in FIGS. 2 and 3, the communication unit 48 is removably mounted on the cradle part 204 in the casing 34 (main cassette body 25 of the cassette 24) with the cable 202 being connected to the communication unit 48. The communication unit 48 sends and receives signals including the information of the radiation X detected by the radiation detector 40, to and from the console 28 serving as an external controller.

The cassette 24 with the communication unit 48 mounted on the cradle part 204 has an outer profile in the shape of a flat rectangular parallelepiped.

A shield plate of lead or the like should preferably be placed over the side surfaces of the cassette controller 46 and the communication unit 48 under the irradiated surface 36 of the casing 34 to protect the cassette controller 46 and the communication unit 48 against damage which would otherwise be caused if irradiated with the radiation X.

FIG. 3 shows, in fragmentary perspective, the cassette 24 with the communication unit 48 being separated (pulled away) from the cradle part 204 (the main cassette body 25) while the cable 202 is being reeled out from the take-up mechanism 200.

The communication unit 48 has a casing 208 of synthetic resin in which a printed-wiring board 212 is fixedly positioned. The printed-wiring board 212 supports thereon a printed antenna 210 and a transmission and reception control circuit 211. The transmission and reception control circuit 211 includes a baseband processor, a modulator, a demodulator, etc.

In FIG. 3, the printed-wiring board 212 lies parallel to the upper and lower surfaces of the casing 208 and is secured substantially centrally in the casing 208 in the vertical direction. The directivity of the antenna 210 can easily be changed by changing the orientation of the casing 208. Any of the outer surfaces of the casing 208, except the outer surface from which the cable 202 extends, can be placed on a flat surface such as the upper surface of the surgical table 16.

Figure 4A:
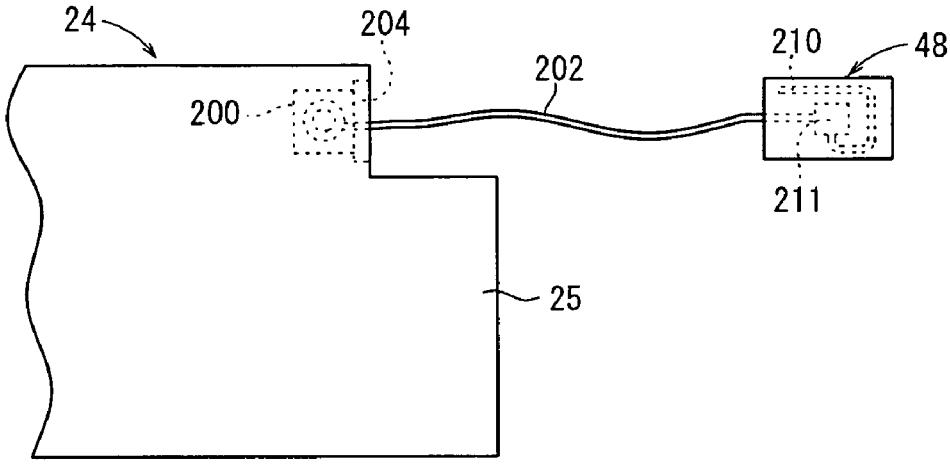
FIG. 4A is a fragmentary plan view showing the manner in which the communication unit is pulled away from the main cassette body which is connected to the communication unit by a cable having no connector.

FIG. 4A shows, in fragmentary plan, the manner in which the communication unit 48 is pulled and separated away from the main cassette body 25 which is connected to the communication unit 48 by a cable 202 having no connector.

Figure 4B:
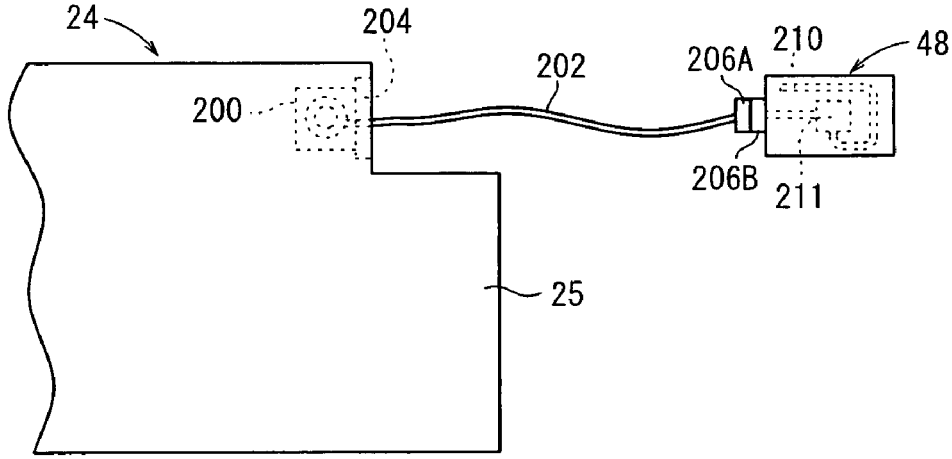
FIG. 4B is a fragmentary plan view showing the manner in which the communication unit is pulled away from the main cassette body which is connected to the communication unit by a cable having a connector assembly on one end thereof.

Alternatively, as shown in FIG. 4B, the communication unit 48 may be connected to the main cassette body 25 by a cable 202 with a connector assembly on one end thereof. The connector assembly comprises a connector 206A connected to the cable 202 and a connector 206B connected to the communication unit 48. The connectors 206A, 206B are detachably connected to each other, so that the communication unit 48 can be disconnected from the cable 202.

Figure 4C:
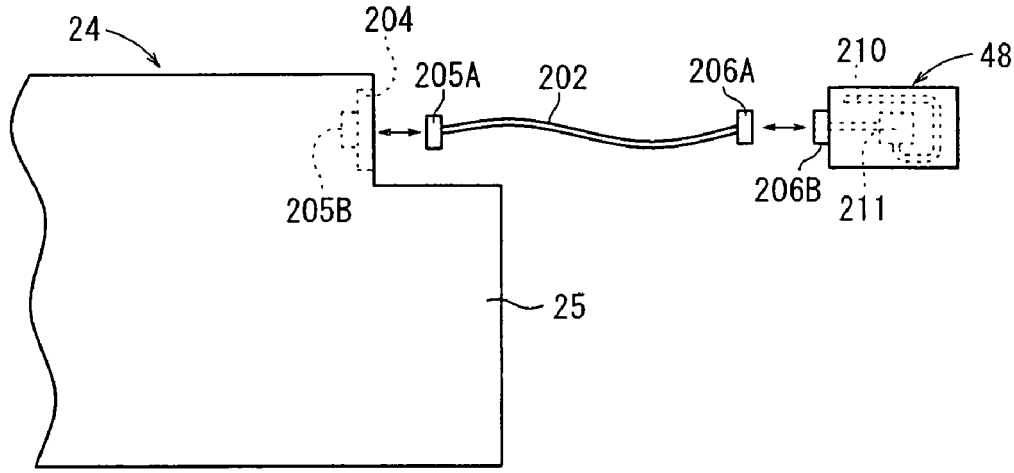
FIG. 4C is a fragmentary plan view showing the manner in which the communication unit and the main cassette body are connected to each other by a cable having connectors on its both ends.

Further alternatively, as shown in FIG. 4C, the communication unit 48 may be connected to the main cassette body 25 by a cable 202 with connectors 205A, 206A on its both ends. The connector 205A is detachably connected to a connector 205B on the main cassette body 25, and the connector 206A is detachably connected to a connector 206B on the communication unit 48.

Connectors (the connectors 205A, 205B or the connectors 206A, 206B) may be connected to the main cassette body 25 and the cable 202 or to the cable 202 and the communication unit 48 (as shown in FIG. 4B), so that the communication unit 48 can be removably connected to the main cassette body 25.

FIG. 5 shows in block form a circuit arrangement of the radiation detector 40. As shown in FIG. 5, the radiation detector 40 comprises an array of thin-film transistors (TFTs) 62 arranged in rows and columns, a photoelectric conversion layer 61 made of a material such as amorphous selenium (a-Se) for generating electric charges upon detection of radiation X, the photoelectric conversion layer 61 being disposed over the array of TFTs 62, and an array of storage capacitors 63 connected to the photoelectric conversion layer 61. When the radiation X is applied to the radiation detector 40, the photoelectric conversion layer 61 generates electric charges, and the storage capacitors 63 store the generated electric charges. Then, the TFTs 62 are turned on along each row at a time to read the electric charges from the storage capacitors 63 as an image signal. In FIG. 5, the photoelectric conversion layer 61 and one of the storage capacitors 63 are shown as making up a pixel 60, wherein the pixel 60 is connected to one of the TFTs 62. Details of the other pixels 60 are omitted from illustration. Since amorphous selenium tends to change its structure and lose its function at high temperatures, it needs to be used within a certain temperature range. Therefore, some means for cooling the radiation detector 40 should preferably be provided in the cassette 24.

The TFTs 62 which are connected to the respective pixels 60, are also connected to respective gate lines 64 extending in parallel to the rows, and to respective signal lines 66 extending in parallel to the columns. The gate lines 64 are connected to a line scanning driver 68, and the signal lines 66 are connected to a multiplexer 76 serving as a reading circuit.

The gate lines 64 are supplied with control signals Von, Voff from the line scanning driver 68 for turning on and off the TFTs 62 along the rows. The line scanning driver 68 comprises a plurality of switches SW1 for switching between the gate lines 64, and an address decoder 70 for outputting a selection signal for selecting one of the switches SW1 at a time. The address decoder 70 is supplied with an address signal from the cassette controller 46.

The signal lines 66 are supplied with electric charges stored in the storage capacitors 63 of the pixels 60 through the TFTs 62 arranged in the columns. The electric charges supplied to the signal lines 66 are amplified by amplifiers 72 connected respectively to the signal lines 66. The amplifiers 72 are connected through respective sample and hold circuits 74 to the multiplexer 76. The multiplexer 76 comprises a plurality of switches SW2 for successively switching between the signal lines 66 and an address decoder 78 for outputting a selection signal for selecting one of the switches SW2 at a time. The address decoder 78 is supplied with an address signal from the cassette controller 46. The multiplexer 76 has an output terminal connected to an A/D converter 80. A radiation image signal generated by the multiplexer 76 based on the electric charges from the sample and hold circuits 74 is converted by the A/D converter 80 into a digital image signal representing radiation image information, which is supplied to the cassette controller 46. The cassette controller 46 is connected to the transmission and reception control circuit 211 of the communication unit 48 by the cable 202.

FIG. 6 shows in block form the radiation image capturing system 12 which comprises the image capturing apparatus 22, the cassette 24, the display device 26, and the console 28. The console 28 is connected to a radiology information system (RIS) 29, which generally manages radiation image information handled by the radiological department of the hospital along with other information. The RIS 29 is connected to a hospital information system (HIS) 31, which generally manages medical information in the hospital.

The image capturing apparatus 22 comprises an image capturing switch 82, a radiation source 84 for outputting the radiation X, a transceiver 86 for receiving image capturing conditions from the console 28 by way of wireless communications and transmitting an image capturing completion signal, etc. to the console 28 by way of wireless communications, and a radiation source controller 88 for controlling the radiation source 84 based on an image capturing start signal supplied from the image capturing switch 82 and image capturing conditions supplied from the transceiver 86.

As shown in FIG. 2, the cassette 24 houses therein the radiation detector 40, the battery 44, the cassette controller 46, the take-up mechanism 200, the cradle part 204, and the communication unit 48 when it is mounted on the cradle part 204.

The cassette controller 46 comprises an address signal generator 90 for supplying address signals to the address decoder 70 of the line scanning driver 68 and the address decoder 78 of the multiplexer 76 of the radiation detector 40, an image memory 92 for storing the radiation image information detected by the radiation detector 40, and a cassette ID memory 94 for storing cassette ID information for identifying the cassette 24.

When the communication unit 48 is electrically connected to the cassette controller 46 by the cable 202, the communication unit 48 receives a transmission request signal from the console 28 by way of wireless communications and transmits the cassette ID information stored in the cassette ID memory 94 and the radiation image information stored in the image memory 92 to the console 28 by way of wireless communications. The communication unit 48 is supplied with electric power from the battery 44 via the cable 202.

The display device 26 comprises a receiver 96 for receiving radiation image information from the console 28, a display controller 98 for controlling the display of the received radiation image information, and a display unit 99 for displaying the radiation image information processed by the display controller 98.

The console 28 comprises a transceiver 100 for transmitting and receiving necessary information including radiation image information to and from the image capturing apparatus 22, the cassette 24, and the display device 26 by way of wireless communications through an antenna 122 (see FIG. 1), an image capturing condition manager 101 for managing image capturing conditions required for the image capturing apparatus 22 to capture radiation images, an image processor (image processing means) 102 for processing radiation image information transmitted from the cassette 24, an image memory 103 for storing the radiation image information processed by the image processor 102, a patient information manager 104 for managing patient information of the patient 14 whose images are to be captured, and a cassette information manager (managing means) 105 for managing cassette information including an accumulated exposed dosage transmitted from the cassette 24. The console 28 may be located outside of the operating room 13, assuming that the console 28 can transmit and receive signals to and from the image capturing apparatus 22, the cassette 24, and the display device 26 by way of wireless communications.

The image capturing conditions refer to condition for determining a tube voltage, a tube current, an irradiation time, etc., which are required to apply radiation X at an appropriate dose to an area to be imaged of the patient 14. The image capturing conditions may include an area to be imaged of the patient 14, an image capturing method, etc., for example. The patient information refers to information used for identifying the patient 14, such as the patient's name, gender, patient ID number, etc. Ordering information for instructing the image capturing apparatus 22 to capture an image, including the image capturing conditions and the patient information, can be set directly via the console 28, or can be supplied from an external source to the console 28 via the RIS 29. The cassette information refers to cassette ID information etc. for identifying the cassette 24.

The radiation image capturing system 12 which employs the cassette 24 according to the present embodiment is basically constructed as described above, and operation of the radiation image capturing system 12 will be described below.

The radiation image capturing system 12 is installed in the operating room 13 and used when a radiation image of the patient 14 is required by surgeons 18 who are performing an operation on the patient 14. Before a radiation image of the patient 14 is captured, patient information of the patient 14 to be imaged is registered in the patient information manager 104 of the console 28. If an area to be imaged of the patient 14 and an image capturing method are already known, such conditions are previously registered as image capturing conditions in the image capturing condition manager 101. After the above preparatory process is finished, the surgeons 18 perform an operation on the patient 14.

For capturing a radiation image of the patient 14 during the operation, one of the surgeons 18 or the radiological technician in charge places the cassette 24 in a given position between the patient 14 and the surgical table 16 with the irradiated surface 36 of the cassette 24 facing the image capturing apparatus 22. As shown in FIGS. 1, 3, and 4A, the surgeon 18 or the radiological technician grips the communication unit 48 by hand, pulls the communication unit 48 away from the cradle part 204, and places the communication unit 48 in an appropriate position on the surgical table 16.

At this time, the communication unit 48 supplies a test radio-wave signal from the transmission and reception control circuit 211 to the antenna 210, which radiates a test radio wave, and determines the orientation and position of the communication unit 48, i.e., the position of the antenna 210 of the communication unit 48, such that the reception intensity of the radio wave that is sent from the antenna 210 of the communication unit 48 and received by the transceiver 100 of the console 28 via the antenna 122 thereof will be maximized.

Specifically, as described later with reference to FIGS. 7, 8A, and 8B, the console 28 is provided with a field intensity meter 126, and the communication unit 48 is provided with field intensity indicators (indicating unit) 209. The communication unit 48 is positioned such that the field intensity is maximized, while checking the pointer of the field intensity meter 126 or viewing the field intensity indicators 209.

Then, after having moved the image capturing apparatus 22 to a position confronting the cassette 24, one of the surgeons 18 or the radiological technician turns on the image capturing switch 82 to capture a radiation image of the patient 14.

As shown in FIG. 3, a proximity switch 215 is provided on one surface 214 of the communication unit 48 facing the cassette 24 (or on one surface of the main cassette body 25 of the cassette 24 facing the communication unit 48). As a result, when the image capturing switch 82 is turned on, if the proximity switch 215 is not placed in an OFF-state, i.e., if the communication unit 48 is not pulled away from the cradle part 204 of the cassette 24, but is installed into the cradle part 204 so that the proximity switch 215 is placed in an ON-state, the communication unit 48 detects the ON-state of the proximity switch 215.

When the communication unit 48 detects the ON-state of the proximity switch 215, the transmission and reception control circuit 211 of the communication unit 48 beforehand notifies the radiation source controller 88 of the image capturing apparatus 22, of the ON-state of the proximity switch 215 through the transceiver 86 and the transceiver 100 of the console 28, and/or notifies the image capturing condition manager 101 of the console 28, of the ON-state through the transceiver 100.

Thus, when the image capturing switch 82 is turned on, the radiation source controller 88 issues a warning message such as "Remove the communication unit from the cassette, otherwise the image capturing switch cannot be turned on (closed) to apply radiation", from an unillustrated speaker of the image capturing apparatus 22. By thus providing the proximity switch 215 to the communication unit 48, when it is detected that the communication unit 48 is not separated away from the main cassette body 25 of the cassette 24, turning-on operation to the image capturing switch 82 can be cancelled.

The proximity switch 215 serves as a detecting unit (separation detecting unit) for detecting whether the communication unit 48 is separated away from the main cassette body 25 of the cassette 24 or not.

When the proximity switch 215 is placed in an OFF-state, i.e., when the communication unit 48 is separated away from the cassette 24, the communication unit 48 beforehand notifies the radiation source controller 88 and/or the image capturing condition manager 101 of the OFF-state of the proximity switch 215. In this case, when the image capturing switch 82 is turned on, the radiation source controller 88 of the image capturing apparatus 22 acquires the image capturing conditions for an area to be imaged of the patient 14 from the image capturing condition manager 101 of the console 28 via the transceivers 100, 86 by way of wireless communications. The radiation source controller 88 then controls the radiation source 84 to apply a radiation X at a given dose to the patient 14 according to the acquired image capturing conditions.

The radiation X which has passed through the patient 14 is applied to the grid 38, which removes scattered rays of the radiation X. Then, the radiation X is applied to the radiation detector 40, and converted into electric signals by the photoelectric conversion layer 61 of the pixels 60 of the radiation detector 40. The electric signals are stored as electric charges in the storage capacitors 63 (see FIG. 5). The stored electric charges, which represent radiation image information of the patient 14, are read from the storage capacitors 63 according to address signals which are supplied from the address signal generator 90 of the cassette controller 46 to the line scanning driver 68 and the multiplexer 76.

Specifically, in response to the address signal supplied from the address signal generator 90, the address decoder 70 of the line scanning driver 68 outputs a selection signal to select one of the switches SW1, which supplies the control signal Von to the gates of the TFTs 62 connected to the gate line 64 corresponding to the selected switch SW1. In response to the address signal supplied from the address signal generator 90, the address decoder 78 of the multiplexer 76 outputs a selection signal to successively turn on the switches SW2 to switch between the signal lines 66 for thereby reading radiation image information represented by the electric charges stored in the storage capacitors 63 of the pixels 60 connected to the selected gate line 64, through the signal lines 66.

The radiation image information (electric charges) read from the storage capacitors 63 of the pixels 60 connected to the selected gate line 64 are amplified by the respective amplifiers 72, sampled by the sample and hold circuits 74, and supplied to the multiplexer 76. Based on the supplied electric charges, the multiplexer 76 generates and supplies a radiation image signal to the A/D converter 80, which converts the radiation image signal into a digital signal. The digital signal which represents the radiation image information is stored in the image memory 92 of the cassette controller 46.

Similarly, the address decoder 70 of the line scanning driver 68 successively turns on the switches SW1 to switch between the gate lines 64 according to the address signal supplied from the address signal generator 90. The electric charges serving as radiation image information stored in the storage capacitors 63 of the pixels 60 connected to the successively selected gate lines 64 are read through the signal lines 66, and processed by the multiplexer 76 and the A/D converter 80 into digital signals, which are stored in the image memory 92 of the cassette controller 46.

The radiation image information stored in the image memory 92 is transmitted to the console 28 by way of wireless communications via the antenna 210 of the communication unit 48. The radiation image information transmitted to the console 28 is received by the transceiver 100, processed by the image processor 102, and then stored in the image memory 103 in association with the patient information of the patient 14 registered in the patient information manager 104.

The processed radiation image information is transmitted from the transceiver 100 to the display device 26 where it is received by the receiver 96. In the display device 26, the display controller 98 controls the display unit 99 to display a radiation image based on the radiation image information. The surgeons 18 perform the operation on the patient 14 while confirming the radiation image displayed on the display unit 99.

Since no cables for transmitting and receiving signals are connected between the cassette 24 and the console 28, between the image capturing apparatus 22 and the console 28, and between the console 28 and the display device 26, no such cables are placed on the floor of the operating room 13. Therefore, a tidy working environment is established in the operating room 13 to allow surgeons 18 to work efficiently and smoothly without being hampered by obstacles such as cables.

According to a cassette of the related art which is designed to accommodate an antenna therein, it may be difficult for the cassette to have an antenna of such specifications for the frequency and wavelength used for desired wireless communications because of its relationship to the layout of the battery and other components in the cassette. With the cassette 24 according to the present embodiment, the antenna 210 is accommodated in the communication unit 48, and the communication unit 48 is electrically connected to the cassette 24 by the cable 202. Accordingly, the antenna 210 may be of a configuration suitable for the frequency and wavelength used for desired wireless communications. As a result, the cassette 24 and the console 28 can achieve stable communications therebetween and hence the display device 26 can display high-quality radiation images.

As described above, the cassette 24 according to the present embodiment includes the main cassette body 25 having the radiation detector 40 for detecting the radiation X that has passed through the subject, i.e., the patient 14, and converting the detected radiation X into radiation image information, and the communication unit 48 which is connected to the main cassette body 25 by the cable 202 and detachably mounted on the cradle part 204 of the main cassette body 25 for wireless communications with the console 28 as an external control device. Since the cassette 24 can be carried around with the communication unit 48 being mounted on the main cassette body 25 by the cradle part 204, the operator does not find the cable 202 cumbersome when the cassette 24 is carried around. As radiation image information can be captured in the cassette 24 while the communication unit 48 is being separated (pulled) from the main cassette body 25 with the cable 202 being reeled out, the communication unit 48 and hence the antenna 210 can easily be changed in attitude. Therefore, it is easy to match the directivity of the antenna 210 of the communication unit 48 and the directivity of the antenna 122 of the console 28, so that the cassette 24 and the console 28 can perform wireless communications highly efficiently and the power consumption of the battery 44 can be reduced.

Furthermore, while radiation image information is being captured in the cassette 24, any damage to the communication unit 48 due to the exposure to the radiation X is minimized because the communication unit 48 can be spaced from the main cassette body 25.

The cable 202 is storable in the take-up mechanism 200 so that the cable 202 can be reeled out. Consequently, the cable 202 and the communication unit 48 can be accommodated compactly in the main cassette body 25. The take-up mechanism 200 may be incorporated in the communication unit 48 rather than in the main cassette body 25. The cable 202 can be reeled out to a desired length from the take-up mechanism 200, kept extended to the desired length, and automatically be wound up automatically under the tension of the tension spring, like a tape measure.

Figure 9:
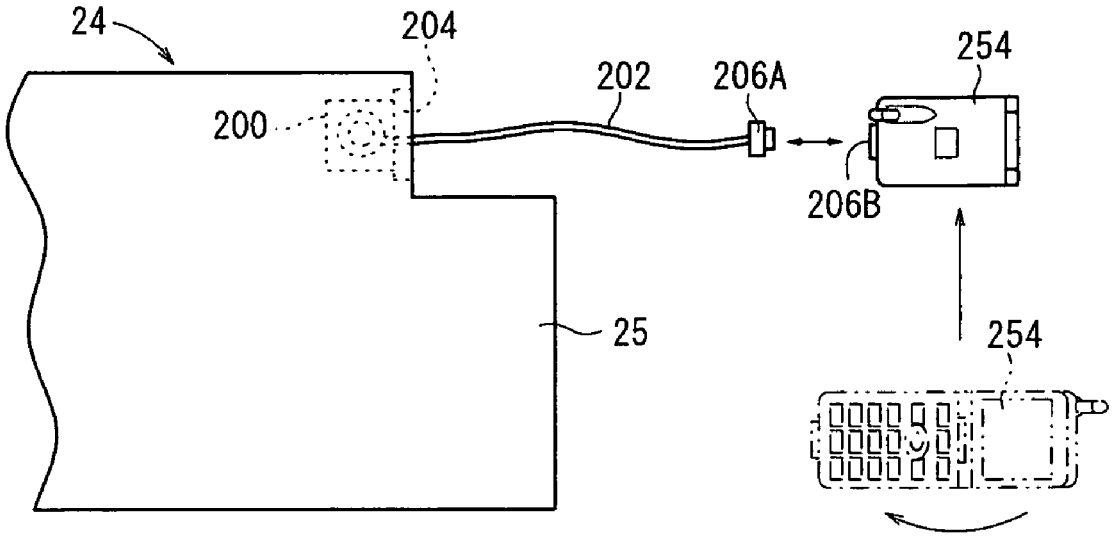
FIG. 9 is a fragmentary plan view of a modification in which a mobile terminal instead of the communication unit is connected to the main cassette body.

FIG. 9 shows a modification in which the communication unit 48 is replaced with a mobile terminal 254 such as a PHS phone, a cellular phone, or the like. According to the modification, the cassette 24 can perform wireless communications with the transceiver 100 of the console 28 via an existing communication infrastructure including a base station and a switching system that are installed in the hospital. The mobile terminal 254 should preferably be water-resistant. The mobile terminal 254, which is of a foldable type, has the connector 206B which can be electrically connected to the connector 206A of the cable 202.

Though not shown, the communication unit 48 and the cassette controller 46 (see FIG. 2) may be combined into an integral cassette controller communication unit that is detachably connected to the main cassette body 25 by the cable 202 which can be reeled out from the take-up mechanism 200. If such an integral cassette controller communication unit is employed, then it may be covered with a thin shield plate of lead. As the integral cassette controller communication unit may be spaced from the main cassette body 25 having the radiation detector 40 while radiation image information is being captured in the cassette 24, any damage to the integral cassette controller communication unit due to the exposure to the radiation X is minimized.

In addition, the battery 44 may also be integrally combined with the integral cassette controller communication unit to provide an integral battery cassette controller communication unit that is detachably connected to the main cassette body 25 by the cable 202 which can be reeled out from the take-up mechanism 200. If an integral battery cassette controller communication unit is employed, then the main cassette body 25 includes only the radiation detector 40 as an active component.

Figure 7:
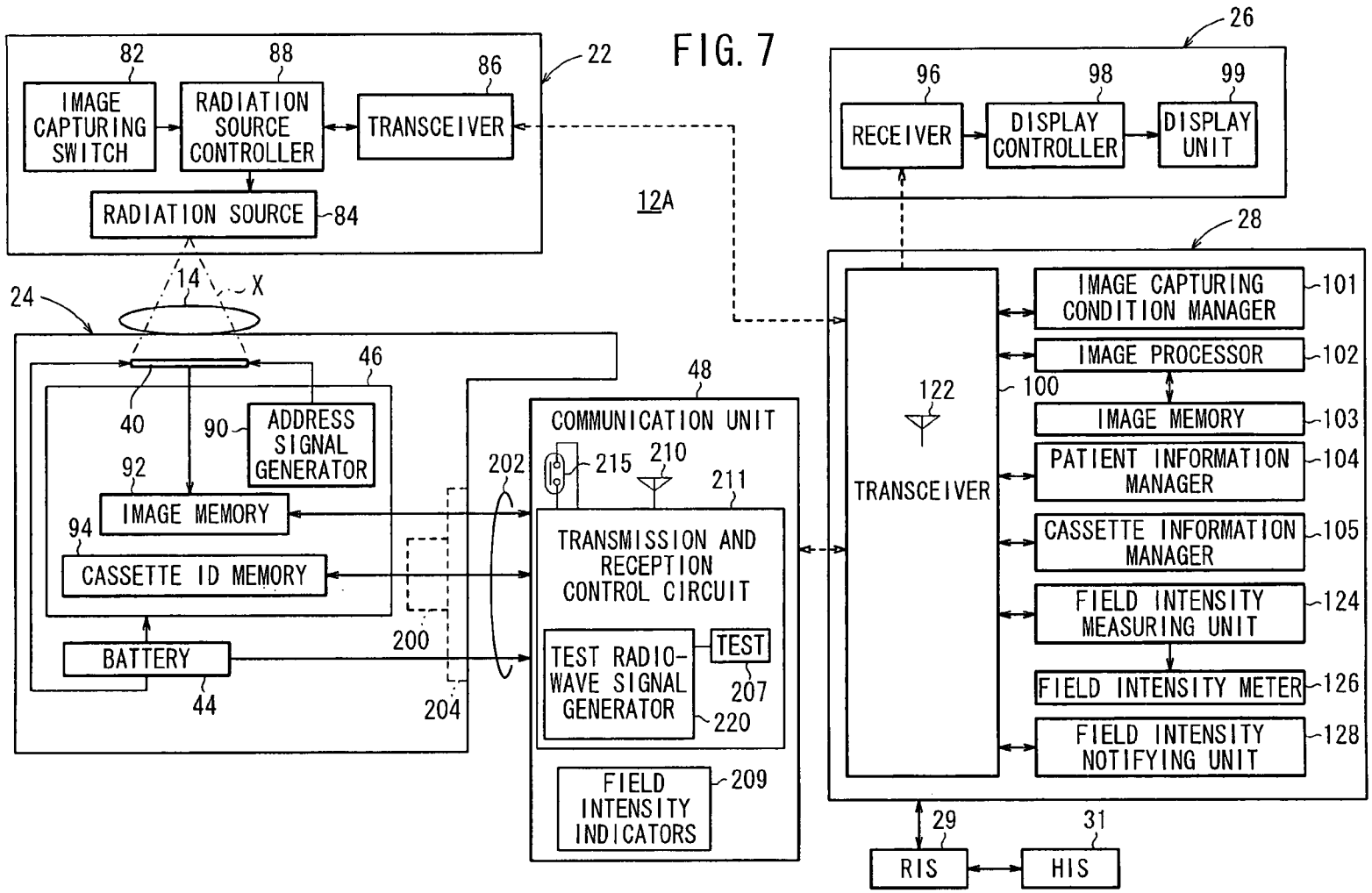
FIG. 7 is a block diagram of a radiation image capturing system according to another embodiment of the present invention.

FIG. 7 shows in block form a radiation image capturing system 12A according to another embodiment of the present invention. The radiation image capturing system 12A is similar to the radiation image capturing system 12 shown in FIG. 6 except that the console 28 additionally includes a field intensity measuring unit (a field intensity measuring and determining unit) 124, a field intensity meter (field intensity information notifying means) 126 such as a VU meter or the like, and a field intensity notifying unit 128, and the communication unit 48 includes a test radio-wave signal generator 220, a test switch button 207, and field intensity indicators 209.

Figure 8A:
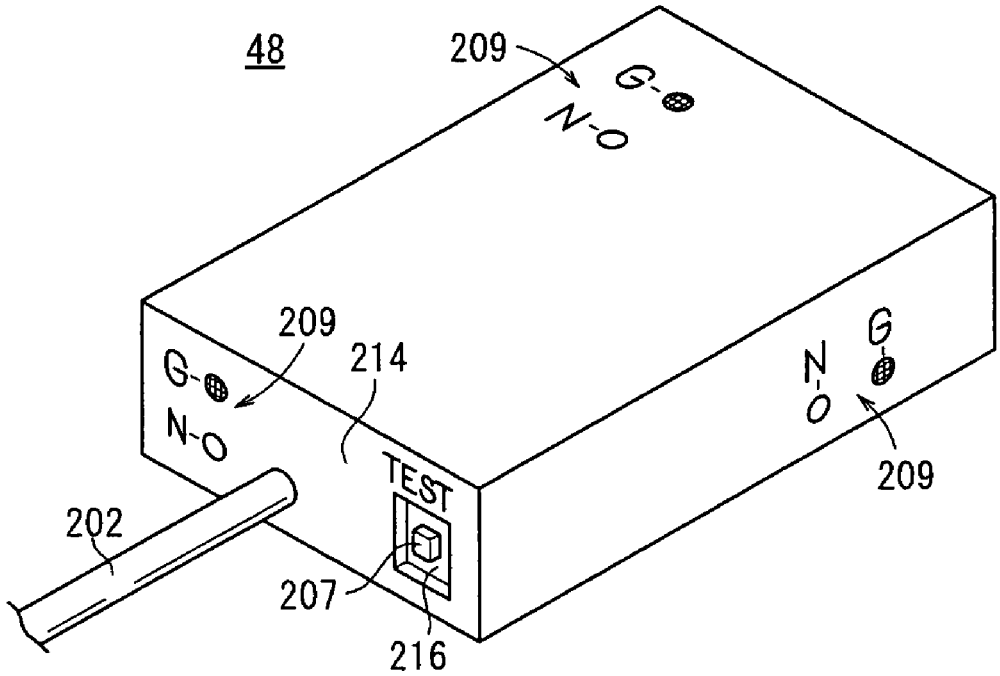
FIG. 8A is a perspective view of a communication unit with a field intensity information notifying means.

As shown in FIG. 8A, the field intensity indicators (field intensity information notifying means) 209 of the communication unit 48 are mounted respectively on all the six surfaces of the rectangular parallelepipedonal communication unit 48. Each of the field intensity indicators 209 comprises a green LED (Light-Emitting Diode) associated with the letter "G" and a red LED associated with the letter "N". When the field intensity is acceptable, i.e., is equal to or higher than a predetermined level, the green LEDs on all the six surfaces of the communication unit 48 are simultaneously turned on. When the field intensity is not acceptable, i.e., is lower than the predetermined level, the red LEDs on all the six surfaces of the communication unit 48 are simultaneously turned on.

The communication unit 48 includes a surface 214, which is one of the six surfaces of the communication unit 48 that faces the cradle part 204 (see FIG. 3 etc.), having a recess 216 (see FIG. 8A) defined therein. The recess 216 houses therein the test switch button 207 which is connected to the test radio-wave signal generator 220.

The radiation image capturing system 12A shown in FIG. 8 operates as follows: When one of the surgeons 18 or the radiological technician pulls the communication unit 48 from the cradle part 204 and positions the communication unit 48 on the surgical table 16 (see FIG. 1) before capturing a radiation image of the patient 14, the surgeon 18 or the radiological technician presses the test switch button 207. The test radio-wave signal generator 220 is then turned on to send a predetermined test radio wave from the transmission and reception control circuit 211 via the antenna 210.

The radiated test radio wave is received by the transceiver 100 of the console 28 via the antenna 122 thereof. The field intensity measuring unit 124 measures the field intensity of the received test radio wave and determines whether or not the field intensity of the measured test radio wave is equal to or higher than a predetermined field intensity for smooth wireless communications.

The determined result is transmitted from the field intensity notifying unit 128 of the console 28 to the communication unit 48 via the transceiver 100 and the antenna 122.

On the basis of the received determined result, the communication unit 48 turns on the green LEDs or the red LEDs of the field intensity indicators 209. In FIG. 8A, the green LEDs are shown as being turned on, indicating that the field intensity of the measured test radio wave is acceptable.

Figure 8B:
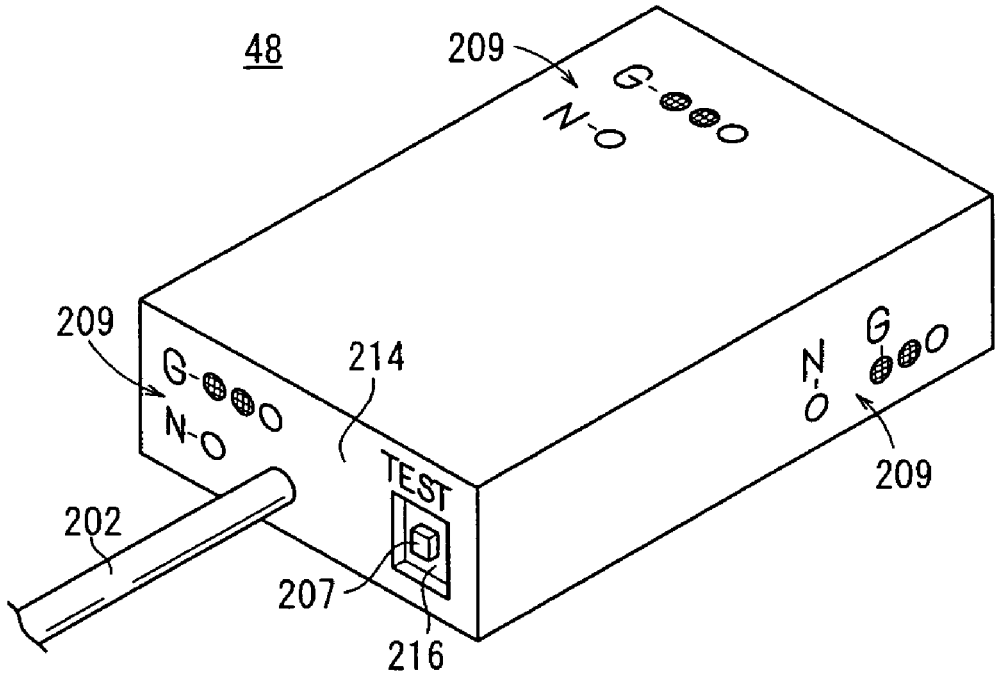
FIG. 8B is a perspective view of a communication unit with a field intensity information notifying means according to another embodiment of the present invention.

As shown in FIG. 8B, the field intensity indicators 209 may produce a stepped or stepless indication depending on the field intensity of the measured test radio wave at a time "G" when the field intensity is acceptable. In FIG. 8B, the indication at the time "G" has three levels, and two green LEDs are turned on, indicating a second level. In the communication unit 48 shown in FIG. 8B, when all the three green LEDs for the time "G" are turned on, the field intensity is maximum. By changing the position of the communication unit 48, the communication unit 48 may be positioned such that the greatest number of green LEDs for the time "G" are turned on.

The determined result of the field intensity may be indicated to surgeons 18 and the like, with sounds. Also, the determined result may be displayed on the display unit 99 of the display device 26.

The field intensity of the test radio wave measured by the field intensity measuring unit 124 is also displayed by the field intensity meter 126 of the console 28. Also, the determined result may be displayed on the console 28. When positioning the communication unit 48, the surgeon 18 or the radiological technician can place the communication unit 48 in a position where the field intensity is maximum, by seeing the field intensity displayed by the field intensity meter 126. The test radio wave may be generated in the console 28 rather than in the communication unit 48.

The present invention is not limited to the illustrated embodiments. However, changes and modifications may be made to the embodiments without departing from the scope of the invention.

For example, according to the illustrated embodiments, the radiation image capturing system 12 is used while an operation is being performed on the patient 14, to display radiation images of the patient 14 on the display device 26. However, the radiation image capturing system 12 is also applicable to capture other radiation images than those captured in surgical operations.

In the radiation image capturing systems according to the embodiments, the radiation detector 40 housed in the cassette 24 directly converts the dose of the applied radiation X into an electric signal via the photoelectric conversion layer 61. However, the radiation image capturing systems may employ a radiation detector including a scintillator for converting the applied radiation X into visible light together with a solid-state detecting device made up of amorphous silicon (a-Si) or the like for converting the visible light into electric signals (see Japanese Patent No. 3494683).

Alternatively, the radiation image capturing systems may employ a light-conversion radiation detector for acquiring radiation image information. The light-conversion radiation detector operates as follows: When radiation is applied to a matrix of solid-state detecting devices, the solid-state detecting devices store an electrostatic latent image depending on the dose of the applied radiation. For reading the stored electrostatic latent image, reading light is applied to the solid-state detecting devices, thereby causing the solid-state detecting devices to generate an electric current representing the radiation image information. When erasing light is applied to the radiation detector, radiation image information representing a residual electrostatic latent image is erased from the radiation detector, which can thus be reused (see Japanese Laid-Open Patent Publication No. 2000-105297).

Signals may be transmitted and received between the image capturing apparatus 22, the display device 26, and the console 28 by way of wired communications.

When the cassette 24 is used in an operating room 13 or the like, the cassette 24 may be subjected to adhesion of blood, contamination, etc. However, when the cassette 24 is designed to have a waterproof and hermetically-sealed structure, and is sterilized and cleaned as necessary, one cassette 24 can be used repeatedly.

The cassette 24 is not limited to being used in the operating room 13, but may be used in combination with medical examinations and doctor's visits to patient rooms in the hospital.

Also, the cassette 24 may communicate with the console 28 as an external device via optical wireless communication using infrared light or the like, instead of general wireless communication using radio wave.

Figure 10:
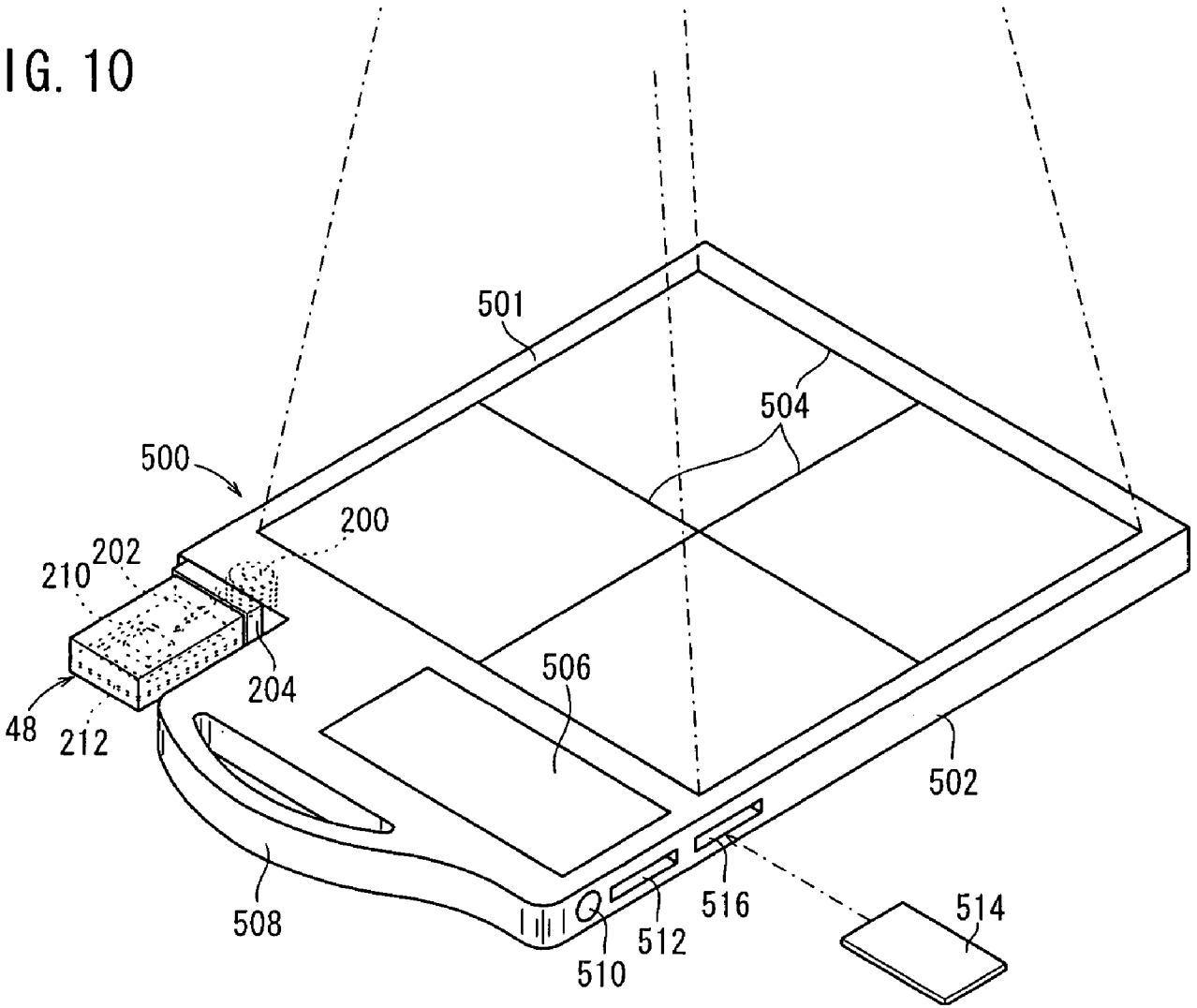
FIG. 10 is a perspective view of a cassette according to another embodiment of the present invention.

Preferably, the cassette 500 may be constructed as shown in FIG. 10.

Specifically, the cassette 500 includes a guiding line 504 drawn on the radiation-irradiated surface of a casing 502, the guiding line 504 serving as a reference for setting a captured area and a captured position. Using the guiding line 504, a subject such as a patient 14 can be positioned with respect to the cassette 500, and an area irradiated with the radiation X can be set, thereby recording radiation image information on an appropriate captured area.

The cassette 500 is provided with a display section 506 on an area thereof other than the captured area, for displaying various information about the cassette 500. The information which is displayed on the display section 506, includes ID information of a subject such as the patient 14 whose radiation image information is to be recorded on the cassette 500, the number of times the cassette 500 has been used, an accumulated exposed radiation dose, a charging state (remaining battery level) of a battery 44 in the cassette 500, image capturing conditions of radiation image information, and a positioning image of the subject such as the patient 14 with respect to the cassette 500. In this case, a technician confirms a subject based on the ID information displayed on the display section 506, for example, and also previously confirms that the cassette 500 is placed in a usable state. Then, the technician positions a desired captured area of the subject such as the patient 14 with respect to the cassette 500 based on the displayed positioning image, thereby capturing appropriate radiation image information.

Also, the cassette 500 includes a handle 508 to be gripped by the user, whereby it is easier to handle and carry the cassette 500.

Preferably, the cassette 500 may have, on a side thereof, an input terminal 510 for an AC adapter, a USB (Universal Serial Bus) terminal 512, and a card slot 516 for inserting a memory card 514.

When the charging function of the battery 44 in the cassette 500 becomes deteriorated, or when there is not enough time to fully charge the battery 44, the input terminal 510 is connected to the AC adapter to externally supply the cassette 500 with electric power, thereby enabling the cassette 500 to be used immediately.

The USB terminal 512 or the card slot 516 may be used when the cassette 500 cannot transmit and receive information to and from external devices such as the console 28 via wireless communication. Specifically, by connecting a cable to the USB terminal 512, the cassette 500 can transmit and receive information to and from the external devices via wire communication. Alternatively, the memory card 514 is inserted into the card slot 516, and necessary information is recorded on the memory card 514. After that, the memory card 514 is removed from the card slot 516, and the memory card 514 is inserted into the external device, thereby enabling information to be transferred.

The cassette 500 is combined with the communication unit 48. Specifically, the communication unit 48 is mounted on the cradle part 204 of a main cassette body 501 with the cable 202 being wound up by the take-up mechanism 200 housed in the main cassette body 501. Since the operator can carry around the cassette 500 with the communication unit 48 mounted thereon by gripping the handle 508, the operator does not find the cable 202 cumbersome. As the communication unit 48 can be separated from the main cassette body 501 with the cable 202 being reeled out from the take-up mechanism 200 while radiation image information is being captured in the cassette 500, the communication unit 48 and hence the antenna 210 can easily be changed in attitude.

Figure 11:
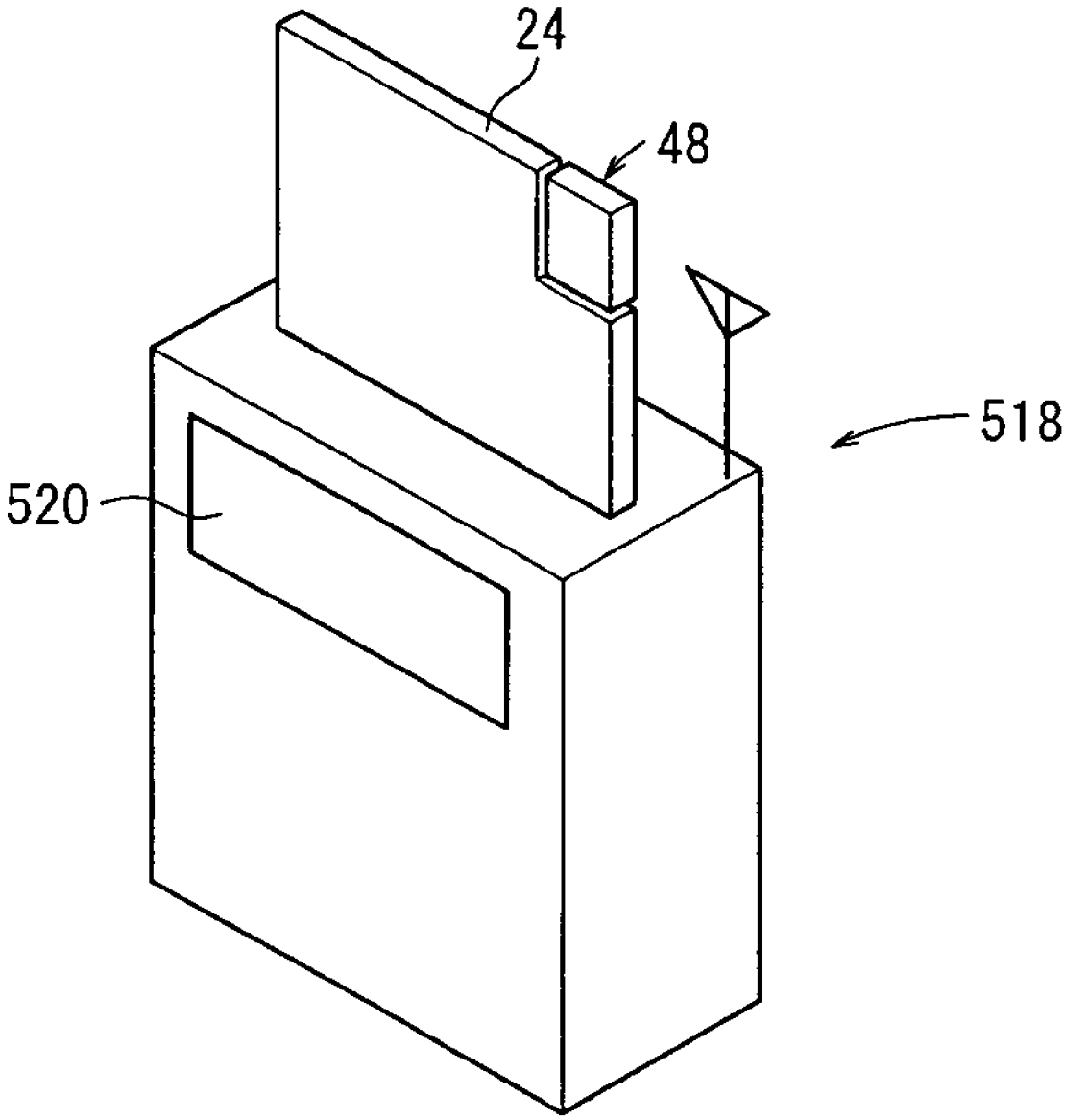
FIG. 11 is a perspective view of a cradle for charging a battery in the cassette.
Figure 12:
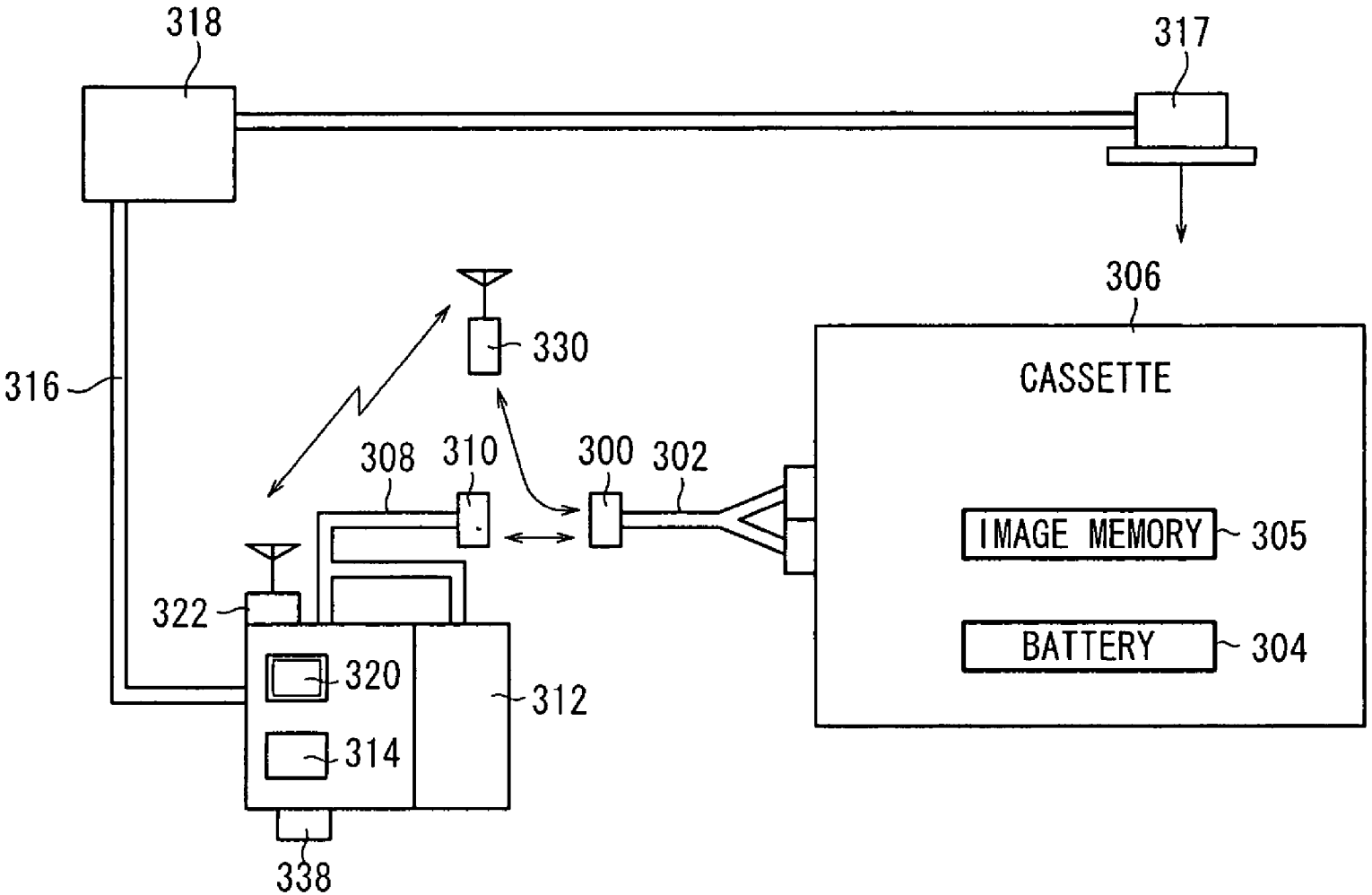
FIG. 12 is a block diagram of a radiation image capturing system according to the related art.

Preferably, a cradle 518 may be disposed in the operating room 13 or at a desired place in the hospital, into which the cassette 24 is inserted to charge the internal battery 44, as shown in FIG. 11. In this case, in addition to charging the battery 44, the cradle 518 may transmit and receive necessary information to and from external devices such as HIS 31, RIS 29, the console 28, etc. by way of wireless or wire communications of the cradle 518. The information may include radiation image information which is recorded on the cassette 24 inserted into the cradle 518.

Also, the cradle 518 may be provided with a display section 520. The display section 520 may display necessary information including a charging state of the inserted cassette 24 and radiation image information acquired from the cassette 24.

Further, a plurality of cradles 518 may be connected to a network. In this case, information about charging states of cassettes 24 inserted in respective cradles 518 can be collected through the network, and the cassette 24 in a usable state can be located.

Although certain preferred embodiments of the present invention have been shown and described in detail, it should be understood that various changes and modifications may be made therein without departing from the scope of the appended claims.

What is claimed is:

1. A cassette comprising:

a main cassette body having a radiation detector for detecting a radiation that has passed through a subject and converting the detected radiation into radiation image information; and a communication unit for wireless communications with an external control device, said communication unit being connected to said main cassette body by a cable and detachably mounted on said main cassette body, wherein said main cassette body and said cable, or said cable and said communication unit are detachably connected to each other by a connector.

2. A cassette according to claim 1, further comprising a take-up mechanism mounted in said main cassette body or said communication unit, for winding up said cable such that said take-up mechanism allows said cable to be reeled out therefrom in use.

3. A cassette according to claim 1, wherein said communication unit comprises a mobile terminal.

4. A cassette according to claim 1, wherein said communication unit includes an indicating unit for indicating field intensity information of the wireless communications.

5. A cassette according to claim 1, further comprising a detecting unit mounted in said communication unit or said main cassette body, for detecting whether said communication unit is separated away from said main cassette body or not.

6. A cassette according to claim 1, wherein said communication unit is mounted on said main cassette body when said cassette is carried around for preventing said communication unit from dangling.

7. A cassette comprising:

a main cassette body having a radiation detector for detecting a radiation that has passed through a subject and converting the detected radiation into radiation image information; and a communication unit for wireless communications with an external control device, said communication unit being connected to said main cassette body by a cable and detachably mounted on said main cassette body, wherein said communication unit includes an indicating unit for indicating field intensity information of the wireless communications.

8. A cassette comprising:

a main cassette body having a radiation detector for detecting a radiation that has passed through a subject and converting the detected radiation into radiation image information;

a communication unit for wireless communications with an external control device, said communication unit being connected to said main cassette body by a cable and detachably mounted on said main cassette body; and a detecting unit mounted in said communication unit or said main cassette body, for detecting whether said communication unit is separated away from said main cassette body or not.

* * * * *